US006511297B2

(12) United States Patent
Ota et al.

(10) Patent No.: US 6,511,297 B2
(45) Date of Patent: Jan. 28, 2003

(54) COMPRESSOR HAVING CHECK VALVE AND OIL SEPARATOR UNIT

(75) Inventors: Masaki Ota, Kariya (JP); Ken Suitou, Kariya (JP); Tomoji Tarutani, Kariya (JP); Kazuya Kimura, Kariya (JP); Ryo Matsubara, Kariya (JP); Taku Adaniya, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 28 days.

(21) Appl. No.: 09/886,170

(22) Filed: Jun. 21, 2001

(65) Prior Publication Data

US 2001/0055532 A1 Dec. 27, 2001

(30) Foreign Application Priority Data

Jun. 27, 2000 (JP) ..... 2000-192341

(51) Int. Cl.[7] ..... F04B 1/26
(52) U.S. Cl. ..... 417/222.2
(58) Field of Search ..... 417/222.2, 313, 417/269, 270, 312; 184/6.17

(56) References Cited

U.S. PATENT DOCUMENTS

| | | | | |
|---|---|---|---|---|
| 3,922,114 A | * | 11/1975 | Hamilton et al. | 184/6.16 |
| 5,090,873 A | * | 2/1992 | Fain | 184/6.23 |
| 5,577,894 A | * | 11/1996 | Kawaguchi et al. | 417/222.2 |
| 6,015,269 A | | 1/2000 | Ota et al. | |
| 6,149,397 A | | 11/2000 | Mizutani et al. | |
| 6,203,284 B1 | * | 3/2001 | Kawaguchi et al. | 417/222.2 |
| 6,435,848 B1 | * | 8/2002 | Minami et al. | 137/514.5 |

* cited by examiner

*Primary Examiner*—Teresa Walberg
*Assistant Examiner*—Vihod D Patel
(74) *Attorney, Agent, or Firm*—Woodcock Washburn LLP

(57) ABSTRACT

Valve and separator unit is mounted to a housing of a compressor. The unit includes a check valve for preventing the reverse flow of refrigerant, and an oil separator for separating a mist of lubricating oil contained in the refrigerant from the refrigerant. Separated lubricating oil is introduced into a crank chamber via an oil passage, and the separated refrigerant is directed to the check valve, which prevents of the reverse flow of the refrigerant from the external refrigerant circuit to the discharge chamber.

11 Claims, 5 Drawing Sheets

COMPRESSOR HAVING CHECK VALVE AND OIL SEPARATOR UNIT

BACKGROUND OF THE INVENTION

1. Field of the Invention

The present invention relates to a compressor, and, more particularly, to a compressor in which moving components are lubricated with a lubricating oil contained in a refrigerant.

2. Description of the Related Art

A variable capacity compressor (hereinafter, referred simply to as a compressor) for use in an automotive air conditioner is known and a typical variable capacity compressor is shown in FIG. 7, for example. That is a housing 101 has a crank chamber 102 formed therein, and a drive shaft 103 is rotatably disposed therein. A lip seal 104 is interposed between the drive shaft 103 and the housing 101 so as to seal off a gap therebetween.

The drive shaft 103 is operatively coupled to an automotive engine Eg as an external drive source via an electromagnetic friction clutch 105 as a power transmission mechanism. The friction clutch 105 comprises a rotor 106 operatively coupled to the automotive engine Eg, an armature 17 fixed to the drive shaft 103 so as to rotate together with the drive shaft 103 and a coil 108. When excited, the coil 108 attracts the armature 107 toward the rotor 106 to fasten the two components together, whereby power can be transmitted between the automotive engine Eg and the drive shaft 103 (the friction clutch 105 is switched on). When the coil 108 is demagnetized in this state, the armature 107 moves away from the rotor 106, whereby power transmission between the automotive engine Eg and the drive shaft 103 is cut off (the friction clutch is switched off).

A rotation support member 109 is fixed to the drive shaft 103 in the crank chamber 102, and a swash plate 110 is coupled to the rotation support unit 109 via a hinge mechanism 111. The swash plate 110 can rotate together with the drive shaft 103 and the inclination angle thereof can be varied relative to the axis L of the drive shaft 103 because it is coupled to the rotation support unit 109 via the hinge mechanism 111. A minimum inclination angle regulating portion 112 is provided on the drive shaft 103 and regulates the minimum inclination angle of the swash plate 110 by abutting thereagainst.

The cylinder bore 113, a suction chamber 114 and a discharge chamber 115 are formed in the housing 101. A piston 116 is reciprocally accommodated in the cylinder bore 113 and is coupled to the swash plate 110.

The rotating motion of the drive shaft 103 is converted into reciprocating motion of the piston 116 via the rotation support unit 109, the hinge mechanism 111 and the swash plate 110, whereby a compression cycle is repeated which is made up of suction step of sucking the refrigerant gas from the suction chamber 114 into the cylinder bore 113 via a suction port 117*a* and a suction valve 117*b* of a valve/port forming unit 117 provided in the housing 102, a compression step of compressing the sucked refrigerant gas and discharge step of discharging the compressed refrigerant gas to the discharge chamber 115 via a discharge port 117*c* and a discharge valve 117*d* of the valve/port forming unit 117.

The suction chamber 114 and the discharge chamber 115 are connected to each other via an external refrigerant circuit, not shown. Refrigerant discharged from the discharge chamber 115 is introduced into the external refrigerant circuit. Heat exchange is carried out in this external refrigerant circuit using the refrigerant. Refrigerant discharged from the external refrigerant circuit is introduced into the suction chamber 114 and is then sucked into the cylinder bore 113 for re-compression.

A gas bleed passage 119 communicates with the crank chamber 102 and the suction chamber 114. A gas supply passage 120 communicates with the discharge chamber 115 and the crank chamber 102. A control valve 121 is disposed in the gas supply passage 120 for regulating the opening degree of the gas supply passage 120.

The control valve 121 is constructed to be driven by an electric current outputted by a drive circuit, not shown, based on a signal from a control computer, not shown, so as to regulate the opening degree of the gas supply passage 120. In the state in which it is not activated by the drive circuit, the control valve 121 operates so as to open the gas supply passage 120, whereas in the state in which it is activated, the control valve 121 operates so as to regulate the opening degree of the gas supply passage 120.

The balance between the amount of the high pressure gas introduced into the crank chamber 102 via the gas supply passage 120 and the amount of the gas flowing out from the crank chamber 102 via the gas bleed passage 119 is controlled by regulating the opening degree of the control valve 121 to thereby determine a crank pressure Pc. A difference between the crank pressure Pc and the internal pressure in the cylinder bore 113 on the opposite side of the piston is varied in response to a variation in the crank pressure Pc and, as a result of a variation in the inclination angle of the swash plate 110, the stroke or the discharge capacity of the piston is regulated.

If, for example, the friction clutch 105 is switched off in response to switching off an air conditioner switch, not shown, from the state in which the compressor is running at the maximum discharge capacity thereof or that the automotive engine Eg is halted, whereby the operation of the compressor is also stopped, activation of the control valve 121 is also stopped (the input current value is zero), and it follows that the gas supply passage 120 is fully opened in a sudden fashion. Consequently, the supply volume of high pressure refrigerant gas from the discharge chamber 115 to the crank chamber 102 is increased suddenly, and since the gas bleed passage 119 cannot bleed the suddenly increased volume of refrigerant gas, the pressure inside the crank chamber 102 is increased excessively. In addition, the pressure inside the cylinder bore 113 is reduced because the pressure tends to become uniform to a lower pressure in the suction chamber 114 due to the stopping of the operation of the compressor. As a result, the difference in pressure between the cylinder bore 113 and the crank chamber 102 is increased excessively.

Due to this, the stash plate 110 inclination angle is set to the minimum inclination angle (shown by chain double-dashed lines in FIG. 7) and it is pressed against the minimum inclination angle regulating portion 112 with an excessively large force and strongly pulls the rotation support unit 109 rearward (rightward as viewed in the figure) via the hinge mechanism 111. As a result, the drive shaft 103 is subjected to a strong moving force acting rearward along the axis L thereof and is forced to slide against the biasing force of a drive shaft biasing spring 118. Due to this, the following problems may be caused.

(a) When the drive shaft 103 slides in the axial L direction, there is a possibility that the sliding position of the lip seal 104 will deviate from a predetermined position called a contact line. There are many cases where foreign matter such as sludge adheres to portions deviating from the contact line on the outer circumferential surface of the drive shaft 103. Due to this, sludge bites into the lip seal 104 and the drive shaft 103 and this reduces the shaft seal performance, whereby a defect such as gas leakage occurs.

(b) When the friction clutch is switched off, in other words, power transmission between the automotive engine Eg and the drive shaft 103 is cut off and, if the drive shaft 103 slides rearward in the axial L direction, the armature 107 fixed to the drive shaft 103 moves toward the rotor 106. A clearance between the rotor 106 and the armature 107 is very small (for example, 0.5 mm) in the state in which the friction clutch 105 is switched off. Consequently, the rearward sliding of the drive shaft 113 along the axial L direction thereof easily eliminates the clearance set between the rotor 106 and the armature 107 and this permits the armature 107 to be brought into sliding contact with the rotating rotor 106, generating abnormal noise and vibrations. Furthermore, a power transmission is permitted to a certain extent.

(c) when the drive shaft 103 slides rearward in the axial L direction thereof, the piston 116 coupled to this drive shaft 103 via the swash plate 110 slides rearward in the cylinder bore 113 and the dead center thereof may deviate toward the valve/port forming unit 117. In addition, the drive shaft 103 continues to rotate for a certain period of time due to inertia immediately after the friction clutch 105 is switched off or the automotive engine Eg is stopped. Consequently, while the driveshaft 103 rotates under inertia, the piston 116 impacts against the valve/port forming unit 117 when it shifts to the top dead center thereof, and this impact causes vibrations and noise.

Note that, to prevent the drive shaft 103 from sliding, it is possible to increase the biasing force of the drive shaft biasing spring 118 as a countermeasure, but this in turn causes new problems in that the durability of a thrust bearing for carrying a great load is deteriorated and that the power loss is increased.

In the aforesaid compressor, to obtain smooth movements of moving components therein, the respective moving components need to be lubricated. To make this happen, in the compressor, a mist of lubricating oil is mixed in the refrigerant so that a mist of lubricating oil is circulated together with refrigerant when the refrigerant circulates between the compressor and the external refrigerant circuit. In the compressor, the moving components are designed to be exposed to the refrigerant, and therefore, the moving components are also exposed to the mist of lubricating oil, this allowing the lubrication of the moving components.

However, the mist of lubricating oil introduced into the external refrigerant circuit in conjunction with the circulation of the refrigerant reduces the efficiency of heat exchange that is to be carried out in the external refrigerant circuit. Moreover, this also means that the lubricating oil is discharged out of the interior of the compressor to the outside thereof, and the volume of lubricating oil inside the compressor is reduced, this deteriorating the lubricating efficiency inside the compressor.

The respective problems caused in association with the increase in pressure in the crank chamber 102 can be solved by the constitution disclosed in Japanese Unexamined Patent Publication (Kokai) No. 11-315785. In this constitution, a check valve for regulating the refrigerant flow direction is provided between the discharge chamber and the external refrigerant circuit, whereby a reverse flow from the external refrigerant circuit to the discharge chamber is prevented. Thus, preventing the reverse flow of refrigerant eliminates a risk of high pressure refrigerant existing on the external refrigerant circuit side being introduced into the crank chamber 102 via a gas supply passage 120 in an aforesaid state in which the gas supply passage 120 is fully opened. This, in turn, eliminates a risk of an internal pressure inside the crank chamber 102 being increased excessively.

In addition, the problem caused by the discharge of lubricating oil to the external refrigerant circuit can be solved by a constitution disclosed, for example, in Japanese Unexamined Patent Publication (Kokai) No. 10-281060. In this constitution, an oil separator is provided in a discharge chamber for separating atomized lubricating oil mixed with refrigerant from the refrigerant so as to prevent the lubricating oil from being discharged to an external refrigerant circuit.

In the former disclosure, however, only the prevention of the reverse flow of refrigerant is dealt with, and no consideration is taken into for the problem of the discharge of lubricating oil into the external refrigerant circuit. Additionally, in contrast to the former disclosure, in the latter disclosure, only the problem of the discharge of lubricating oil into the external refrigerant circuit is dealt with, and no consideration is taken for the problem of the increase in pressure in the crank chamber.

SUMMARY OF THE INVENTION

An object of the present invention is to provide a compressor which can prevent not only the reverse flow of refrigerant from an external refrigerant circuit to a discharge chamber but also the discharge of lubricating oil into the external refrigerant circuit.

To solve the above described problems, the present invention provides a compressor comprising: a housing having a compression chamber, a discharge chamber, and a suction chamber, a refrigerant being sucked from the suction chamber into the compression chamber and discharged from compression chamber into the discharge chamber; a movable member to compress the refrigerant in the compression chamber; a discharge passage connecting the discharge chamber to an external refrigerant circuit; and a suction passage connecting the suction chamber to the external refrigerant circuit; wherein a check valve preventing reverse flow of the refrigerant from the external refrigerant circuit to the discharge chamber, an oil separator separating a mist of lubricating oil contained in the refrigerant from the refrigerant, and an oil passage introducing the separated lubricating oil into a low pressure region in the compressor, are provided in the discharge chamber or the discharge passage.

According to this arrangement, the oil separator separates the refrigerant from the lubricating oil to thereby prevent the lubricating oil from being discharged into the external refrigerant circuit. Since the lubricating oil causes deterioration in heat exchange efficiency in the external refrigerant circuit, the separation can suppress the reduction in the heat exchange efficiency. The lubricating oil separated from the refrigerant is introduced into the low pressure region via the oil supply passage. Preferably, the low pressure region may be the suction chamber, the suction passage, or the crank chamber formed in the housing. This not only prevents the reduction in the amount of the lubricating oil in the compressor including the suction passage but also enables the proper lubrication of the interior of the compressor. In addition, the check valve prevents the reverse flow of the refrigerant from the external refrigerant circuit to the discharge chamber.

Preferably, the oil separator is disposed upstream of the check valve. The oil passage for introducing the lubricating oil separated by the oil separator into the low pressurized region is disposed upstream of the check valve together with the oil separator. That is, even if the downstream side of the check valve is subjected to a higher pressure than the upstream side thereof, there is no risk of the refrigerant existing on the downstream side flowing to the upstream side via the oil passage. Consequently, the reverse flow of refrigerant can be prevented without providing a closing means for closing the oil passage along the same passage.

Preferably, the check valve and the oil separator are integrally arranged as a unit. In this arrangement, a space for installation of the relevant components can be reduced and the fabricating properties can be improved, compared with a construction in which a check valve and an, oil separator are provided separately.

Preferably, the unit comprises a case to which the check valve is attached, the case having a substantially cylindrical portion having an inlet opening for introducing the refrigerant into the case such that the refrigerant turns about an axis of the case, the case also having an outlet for the refrigerant which passes through the check valve after the refrigerant is separated from the lubricating oil, and an outlet for the discharge lubricating oil which is separated from the refrigerant. Preferably, the refrigerant turns in the circumferential gap between an outer circumferential surface of the check valve and an inner surface of the case. In this arrangement, the refrigerant reverse flow preventing function and the lubricating oil separating function carried out by the unit are realized by the case and the check valve accommodated in the case. The mist of lubricating oil mixed in the refrigerant gas introduced into the case is centrifugally separated from the refrigerant while turning inside the case. The refrigerant from which the lubricating oil is separated is introduced into the check valve to be discharged to the external refrigerant circuit side.

Preferably,the check valve comprises a valve casing having a valve seat, a valve element arranged in the valve casing, and an urging member resiliently urging the valve element toward the valve seat, the valve casing being attached to the casing. Preferably, the valve element has an outer circumferential surface and at least one groove axially extending in the outer circumferential surface.

Preferably, the compressor is a variable capacity compressor comprising a crank chamber formed in the housing, a drive shaft rotatably supported in the crank chamber, a swash plate driven for rotation by the drive shaft and supported by the drive shaft so that an inclination angle thereof relative to the drive shaft changes, a piston as the movable member operatively coupled to the swash plate, a cylinder bore for reciprocally accommodating therein the piston and in which the compression chamber is formed by the piston, a gas bleed passage for providing a communication between the suction chamber and the crank chamber, and a control valve for controlling a pressure in the crank chamber so as to vary the stroke of the piston. In this arrangement, in the event that the amount of the circulating refrigerant is reduced, the check valve cuts off the passage of refrigerant between the discharge chamber and the external refrigerant circuit, whereby the flow of the refrigerant to the external refrigerant circuit is suppressed.

Preferably, the low pressure region is the crank chamber, and the lubricating oil separated by the oil separator is supplied to the crank chamber via the oil passage. In this arrangement, the lubricating efficiency of the sliding components of the mechanism in the crank chamber is improved. Since there exist in the crank chamber a relatively large number of sliding components of the mechanism for converting the rotating motion of the drive shaft into the reciprocal motion of the piston, the improvement in the lubricating efficiency of those sliding components is useful in improving the operation efficiency of the compressor.

Preferably, the control valve regulates the opening degree of the oil passage so as to supply lubricating oil separated by the oil separator to the crank chamber and varies the pressure in the crank chamber so as to vary the stroke of the piston. In this arrangement, the lubricating oil can be supplied to the crank chamber during the small capacity operation in which the amount of the circulating refrigerant, as well as the amount of leaking refrigerant from the compression chamber to the crank chamber via the gap between the cylinder bore and the piston is reduced. In addition, since the passage, through which the refrigerant is allowed to pass for varying the pressure in the crank chamber, can be shared as the oil passage, the construction of the compressor can be simplified.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

First Embodiment

Referring to FIGS. 1 to 4, a first embodiment of the present invention will now be described.

Figure 1:
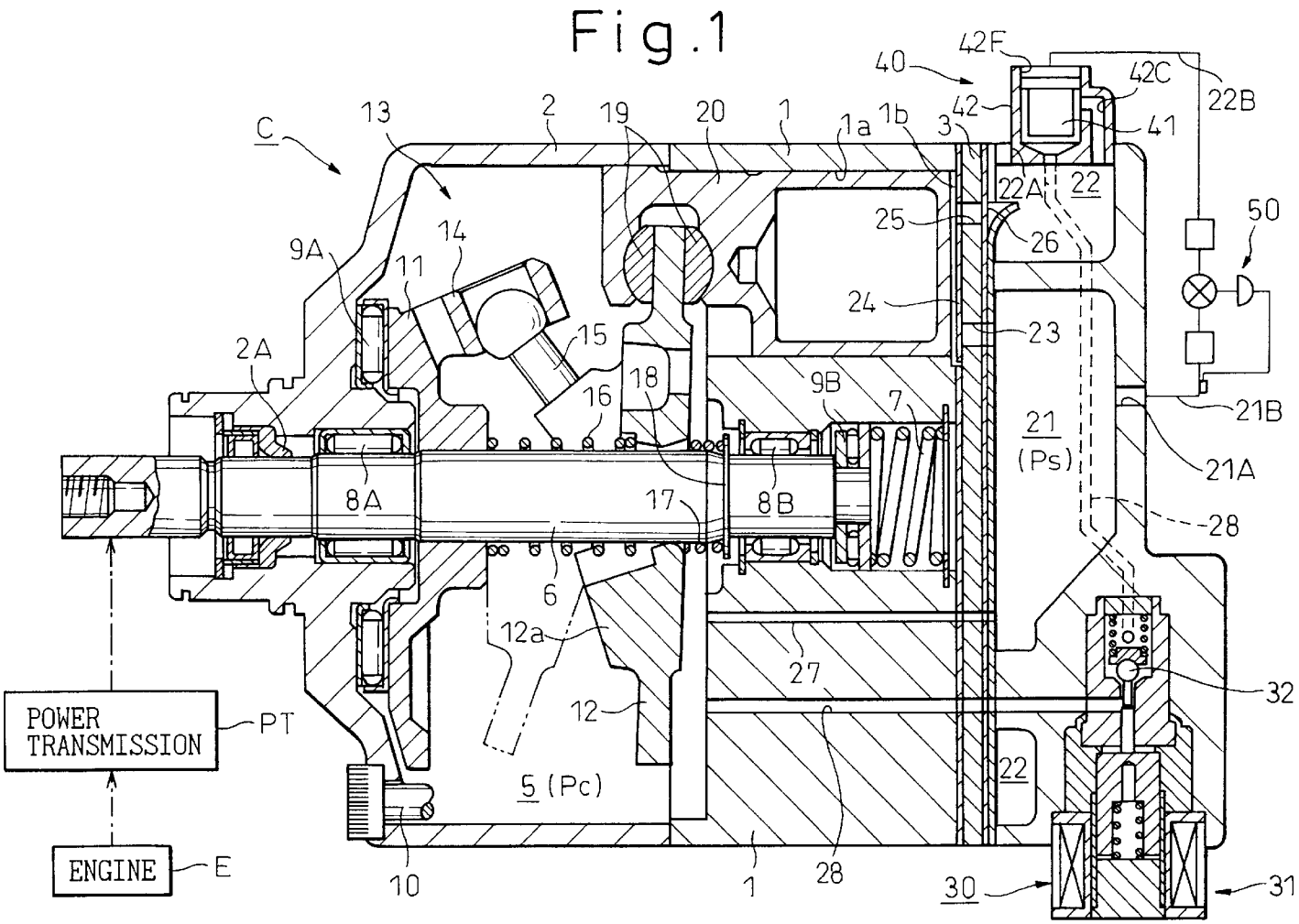
FIG. 1 is a cross-sectional view showing a compressor according to a first embodiment of the invention.

As shown in FIG. 1, a variable capacity type compressor (hereinafter, referred to simply as a compressor) C comprises a cylinder block 1, a front housing 2 joined to the front end of the cylinder block 1, and a rear housing 4 joined to the rear end of the cylinder block 1 via a valve forming unit 3. The cylinder block 1, the front housing 2, the valve forming unit 3 and the rear housing 4 are joined and fixed to each other with a plurality of through bolts 10 (only one through bolt is shown in FIG. 1) to thereby form a housing of the compressor C. A crank chamber 5 is formed in the region surrounded by the cylinder block 1 and the front housing 2. A drive shaft 6 is rotatably supported in the crank chamber 5 by a pair of front and rear radial bearings 8A and 8B. A spring 7 and a rear thrust bearing 9B are disposed in an accommodating recessed portion formed in the center of the cylinder block 1. On the other hand, a lug plate 11 is fixed to the drive shaft 6 in the crank chamber 5 in such a manner that they rotate together, and a front thrust bearing 9A is disposed between the lug plate 11 and the inner wall surface of the front housing 2. The drive shaft 6 and the lug plate 11 which are integrated together are positioned in a thrust direction (in an axial direction of the drive shaft) by means of the rear thrust bearing 9B which is biased forward by the spring 7 and the front thrust bearing 9A. A lip seal 2A is disposed ahead of the radial bearing 8A between the drive shaft 6 and the front housing 2. The lip seal 2A seals off a gap between the drive shaft 6 and the front housing 2 to thereby isolate the interior of the compressor C from the exterior thereof with respect to pressure.

The drive shaft 6 is operatively coupled at the front end portion thereof to an automotive engine E as an external drive source via a power transmission mechanism PT. The power transmission mechanism PT may be a clutch mechanism (for example, an electromagnetic clutch) for selecting the transmission/cut-off of power through an electric control from the outside, or a normally transmitting clutch-less mechanism dispensing with such a clutch mechanism. Note that, in this embodiment, a power transmission mechanism of clutch-less type is used.

As shown in FIG. 1, a swash plate 12 is accommodated in the crank chamber 5 as a cam plate. A through hole is formed in the central portion of the swash plate 12, through which the drive shaft 6 is disposed. The swash plate 12 is operatively coupled to the lug plate 11 and the drive shaft 6 via a hinge mechanism 13 as a coupling guide mechanism. The hinge mechanism 13 is constituted by two supporting arms 14 (only one of them is shown in the figure) provided so as to protrude from the rear side of the lug plate 11 and two guide pins 15 (only one of them is shown in the figure) provided so as to protrude from the front side of the swash plate 12. The swash plate 12 can rotate in synchronism with the lug plate 11 and the drive shaft 6 and can incline relative to the drive shaft 6 while sliding in the axial direction of the drive shaft 6 through linkage between the supporting arms 14 and the guide pins 15, as well as being in contact with the drive shaft 6 within the central through hole in the swash plate 12. Note that the swash plate 12 has a counterweight portion 12*a* which is located at an opposite position to the hinge mechanism 13 so as to hold the drive shaft 6 therebetween.

A tilting angle reducing spring 16 is provided around the circumference of the drive shaft 6 between the lug plate 11 and the swash plate 12. This tilting angle reducing spring 16 biases the swash plate 12 in the direction in which the swash plate 12 is caused to approach the cylinder block 1 (in the direction in which the tilting angle is reduced). In addition, a return spring 17 is provided around the circumference of the drive shaft 6 between a regulating ring 18 secured to the drive shaft 6 and the swash plate 12. The return spring 17 is simply wound around the drive shaft 6 and provides no biasing action to the swash plate and other members when the swash plate 12 is in the position in which the inclination angle is large (shown by chain double-dashed lines), but when the swash plate 12 shifts to the position in which the inclination angle is small (shown by solid lines) the return spring 17 is compressed between the regulating ring 18 and the swash plate 12 and biases the swash plate 12 in the direction in which the swash plate 12 is moved away from the cylinder block (in the direction in which the inclination angle is increased). Note that in this embodiment the inclination angle of the swash plate 12 is regarded as an angle formed by an imaginary plane normal to the drive shaft 6 and the swash plate 12.

A plurality of cylinder bores 1*a* (only one bore is shown in FIG. 1) are formed so as to surround the drive shaft 6, and rear ends of the respective bores 1*a* are closed with the valve forming unit 3. A single headed piston 20 is reciprocally accommodated in each bore 1*a*, and a compression chamber 1*b* is defined in each cylinder bore 1*a* in such a manner as to vary the volume thereof as the piston 20 reciprocates. The front end portion of each piston 20 is engaged with the outer circumferential portion of the swash plate 12 via a pair of shoes 19, so the each piston 20 is operatively coupled to the swash plate 12. Due to this, the swash plate 12 rotates in synchronism with the drive shaft 6, whereby the rotating motion of the swash plate 12 is converted into reciprocating motion of the piston 20 with the stroke corresponding to the inclination angle.

Furthermore, a suction chamber 21 situated at a central region and a discharge chamber 22 surrounding the suction chamber 21 are defined between the valve forming unit 3 and the rear housing 4. The valve forming unit 3 comprises a suction valve forming plate, a port forming plate, a discharge valve forming plate and a retainer forming plate which overlap each other. Formed in the valve forming unit 3 for each cylinder bore 1*a* are a suction port 23 and a suction valve 24 for opening and closing the suction port 23, and a discharge port 25 and a discharge valve 26 for opening and closing the discharge port 26. The suction chamber 21 is allowed to communicate with each cylinder bore 1*a* via the suction port 23, and each cylinder bore 1*a* is allowed to communicate with the discharge chamber 22 via the discharge port 25.

The suction chamber 21 is connected to the crank chamber 5 via a gas bleed passage 27. In addition, the discharge chamber 22 is connected to the crank chamber 5 through a communication passage 28 via a unit 40, which will be described later, and a control valve 30 is provided at an intermediate position in the communication passage 28.

The control valve 30 comprises a solenoid portion 31 and a valve element 32 operatively coupled to the solenoid portion 31 via a rod. The solenoid portion 31 is driven by an electric current outputted by a drive circuit, not shown, based on a signal from a control computer, not shown, and the position of the valve element 32 is changed to thereby adjust the opening degree of the communication passage 28. When not fed from the drive circuit, the valve element 32 is located at a position where the communication passage 28 is open, whereas when fed from the circuit, the valve element 32 is constructed to adjust the opening degree of the communication passage 28.

Balance between the amount of high pressure gas which is to be introduced into the crank chamber 5 via the communication passage 28 and the amount of gas which is to flow out from the crank chamber 5 via the gas bleed passage 27 is controlled by adjusting the opening degree of the control valve 30, whereby the crank pressure Pc is determined. The difference between the crank pressure Pc and the internal pressure of the cylinder bore 1*a* on the opposite side of the piston 20 is varied in response to a change in the crank pressure Pc, and the inclination angle of the swash plate 12 is in turn varied, as a result of which the stroke or the discharge capacity (the amount of circulating refrigerant) is adjusted. In this case, the communication passage 28 and the control valve 30 function as part of a gas supply passage for introducing the refrigerant from the discharge chamber 22 into the crank chamber 5.

Note that a maximum inclination angle of the swash plate 12 is regulated when the counterweight portion 12*a* of the swash plate 12 is brought into abutment with the lug plate 11. On the other hand, the minimum inclination angle thereof is determined by the balance between the biasing forces of the inclination angle reducing spring 16 and the return spring 17 as a dominant factor in a state in which the difference between the crank pressure Pc and the internal pressure of the cylinder bore 1*a* on the opposite side of the piston 20 is maximized in the direction in which the inclination angle is reduced.

A suction opening 21A is provided in the rear housing 4 which functions as an inlet through which the refrigerant is introduced into the suction chamber 21. Additionally, a mounting opening 22A is provided in the rear housing 4 which is in communication with the discharge chamber 22, and the unit 40 having a discharge opening 42F, which will be described later, is mounted to the mounting opening 22A.

An external refrigerant circuit 50 is interposed between the suction opening 21A and the discharge opening 42F.

Figure 2:
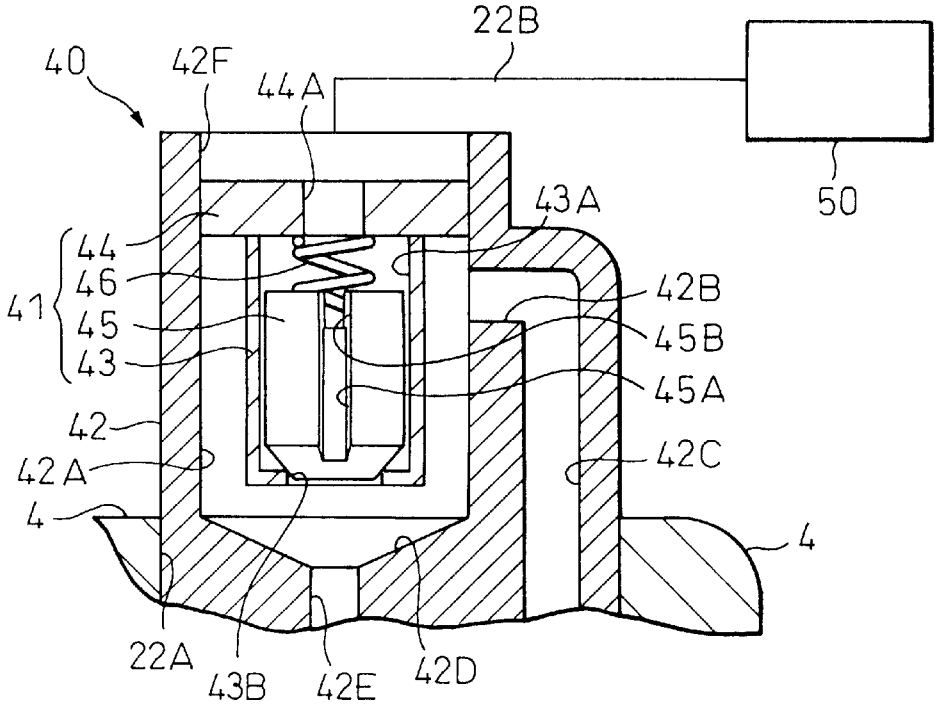
FIG. 2 is an enlarged cross-sectional view showing a main part of the compressor of the first embodiment, with the valve in the closed position.
Figure 4:
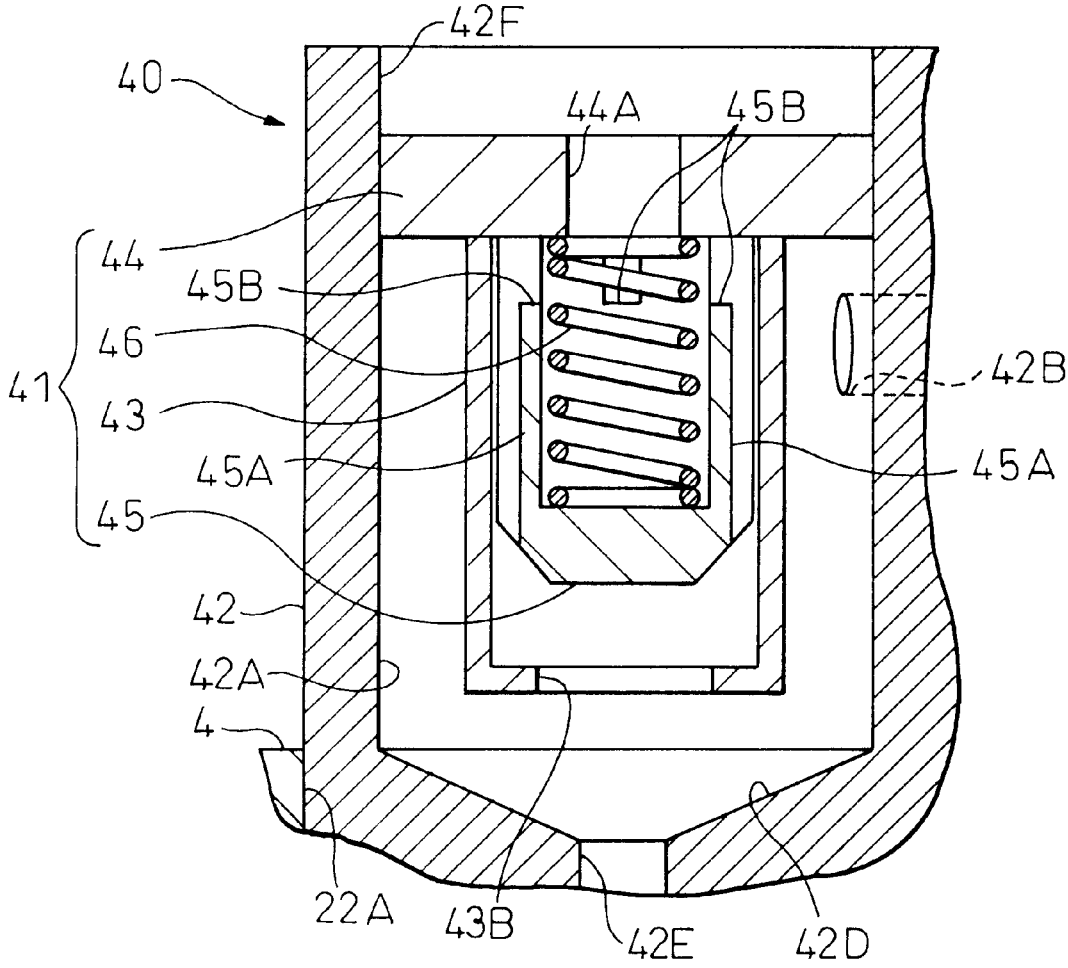
FIG. 4 is an enlarged cross-sectional view showing the main part of the compressor of the first embodiment of the invention, with the valve in the open position.

As shown in FIG. 1, FIG. 2 and FIG. 4, the unit 40 comprises a substantially cylindrical case 42 having a bottom which is mounted to the mounting opening 22A in the rear housing 4, and a check valve 41 accommodated in the case 42. The check valve 41 comprises a disc 44 press fitted in the discharge opening 42F and a substantially cylindrical valve casing 43 having a bottom joined and fixed to the disc 44 at the opening side end face thereof. A valve chamber 43A is formed in the valve casing 43 by covering the opening side end face of the casing 43 with the disc 44. A valve inlet 43B as an inlet for the refrigerant and a valve outlet 44A as an outlet for the refrigerant are formed in the bottom portion of the valve casing 43 and in the disc 44, respectively. A valve element 45 is accommodated in the valve chamber 43A in such a manner as to reciprocate between the valve inlet 43B and the valve outlet 44A. The valve element 45 is constructed so as to be biased toward the valve seat having the valve inlet 43B by a valve closing spring 46.

Figure 3:
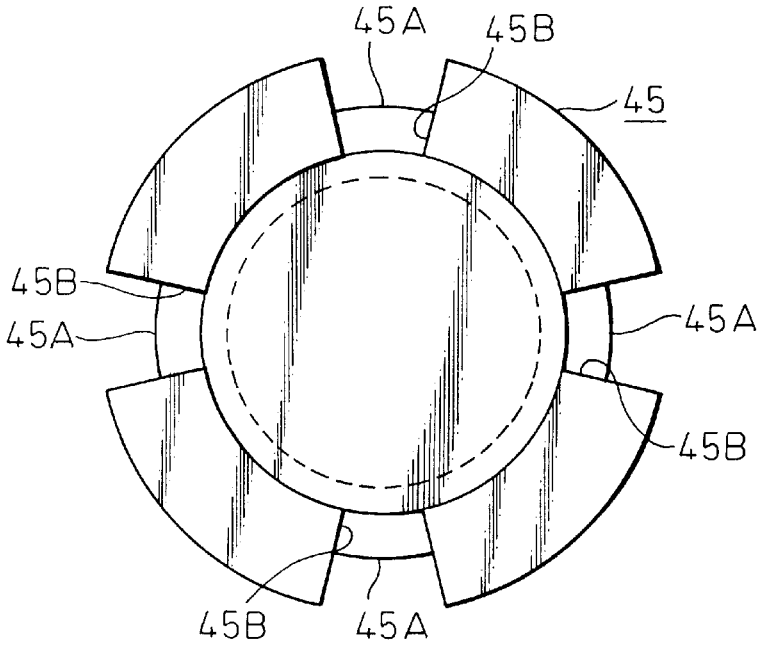
FIG. 3 is an enlarged plan view showing of the valve element of the compressor of the first embodiment, viewed from the top.

The valve element 45 provides a substantially cylindrical shape having a bottom in which the valve element 45 is partially tapered at the bottom portion and the diameter of the valve element 45 decreases as it extends toward the distal end. When the valve element 45 is pressed toward the valve seat having the valve inlet 43B, a part of the tapered portion enters the valve inlet 43B to close the same. A plurality (four in this embodiment) of grooves 45A extending along the axial direction of the valve element 45 are formed on the outer circumferential surface of the valve element 45 (refer to FIG. 3. Note that FIG. 3 shows the valve element 45 as viewed from the open side thereof). Notched portions 45B are formed in the end face of the valve element 45 on the opening side thereof so that the inside and the outside of the valve element 45 are in communication with each other. When the valve element 45 moves toward the disc 44 against the biasing force of the valve closing spring 46, the opening side of the valve element 45 abuts against the disc 44, whereby a further movement of the valve element 45 is restricted. As this occurs, the valve outlet 44A is constructed to be covered with the opening side of the valve element 45 but the valve inlet 43B and the valve outlet 44A are allowed to communicate with each other via the grooves 45A and the notched portions 45B (refer to FIG. 4).

In the check valve 41, the opening and closing operation at the valve inlet 43B is effected by the balance among the biasing force to the valve element 45 by virtue of the refrigerant pressure on the upstream side of the check valve 41, the biasing force to the valve element 45 by virtue of the refrigerant pressure on the downstream side of the check valve 41, and the biasing force by the valve closing valve 46, whereby the reverse flow of the refrigerant is prevented. When the biasing force by virtue of the pressure on the upstream side of the check valve becomes greater than the sum of the biasing force by virtue of, the pressure on the downstream side of the check valve and the biasing force of the valve closing spring 46, the check valve 41 is moved to allow the refrigerant to flow therethrough. On the contrary, when the biasing force by virtue of the upstream side pressure becomes smaller than the sum of the biasing force by virtue of the downstream side pressure and the biasing force of the valve closing spring 46, the check valve 41 is moved to not allow the refrigerant to flow therethrough. That is, the check valve 41 is constructed to prevent a reverse flow of the refrigerant from the downstream side (the external refrigerant circuit 50 side) to the upstream side (the discharge chamber 22 side).

In the state in which the check valve 41 is accommodated in the case 42, the opening side of the case 42 is covered with the disc 44 to thereby define a separation chamber 42A. In addition, a portion of the case 42 which is downstream of the disc 44 (the opening side of the case) functions as the discharge opening 42F for the refrigerant. Note that in FIGS. 1, 2 and 4, as a matter of convenience, a mechanism for fixedly connecting the discharge opening 42F to a flow pipe 22B is not shown. An inlet 42B is formed in the case 42 for introducing the refrigerant from the discharge chamber 22 into the separation chamber 42A. The inlet 42B and the discharge chamber 22 are connected to each other via an introduction passage 42C. The inlet 42B is formed in the circumferential direction of the case 42 such that the refrigerant introduced into the separation chamber 42A turns in the separation chamber 42A about the axis of the case 42. Since the valve casing 43 of the check valve 41 is disposed in the separation chamber 42A, the refrigerant introduced into the separation chamber 42A from the inlet 42B in reality turns along the gap between the inner circumferential surface of the case 42 and the outer circumferential surface of the valve casing 43. A mist of lubricating oil contained refrigerant is centrifugally separated by the turning of the refrigerant in the separation chamber 42A so as to gather on the inner circumferential surface of the case 42.

In addition, a tapered, inclined recessed portion 42D is provided in the bottom portion of the case 42, so that the lubricating oil which gathers on the inner circumferential surface of the case 42 drops to be collected at the deepest portion of the inclined recessed portion 42*d*. A discharge passage 42E is formed in the deepest portion of the inclined recessed portion 42D for discharging the lubricating oil so collected out of the unit 40. As shown in FIG. 1, the lubricating oil discharged out of the unit 40 through the discharge passage 42E is then introduced into the crank chamber 5 as the low pressure region via the communication passage 28 and the control valve 30. Note that the oil separator is constituted by the case 42, the valve casing 43 and the disc 44 for separating a mist of lubricating oil from the refrigerant containing the lubricating oil. In this case, the discharge passage 42E, the communication passage 28 and the control valve 30 function as an oil passage for supplying the lubricating oil so separated into the crank chamber 5. In addition, the introduction passage 42C, the inlet 42B, the separation chamber 42A and the discharge passage 42E of the case 42 function as part of the gas passage for supplying the refrigerant in the discharge chamber 22 to the crank chamber 5.

In addition, a discharge passage for connecting the discharge chamber 22 to the external refrigerant circuit 50 is constituted by the mounting opening 22A, the unit 40 and the flow pipe 22B, and a suction passage for connecting the suction chamber 21 to the external refrigerant circuit 50 is constituted by the suction opening 21A and a flow pipe 21B.

Next, the operation of the compressor constructed as described heretofore will be described.

Power is supplied from the automotive engine E to the drive shaft 6 via the power transmission mechanism PT, so the swash plate 12 rotates together with the drive shaft 6. As the swash plate 12 rotates, the respective pistons are reciprocated with strokes corresponding to the inclination angle of the swash plate 12, whereby the suction, compression and discharge steps of the refrigerant are repeated in that order in each cylinder bore 1*a*.

In the case where the cooling load is large, the control computer outputs a command signal to the drive circuit to increase the value of electric current fed to the solenoid portion 31. The solenoid portion 31 increases the biasing force in response to a change in the electric current value from the drive circuit based on the signal, such that the valve element 32 decreases the opening degree of the communication passage 28, whereby the volume of the high pressure refrigerant gas is reduced which is supplied from the discharge chamber 22 to the crank chamber 5 via the communication passage 28, this reducing the pressure in the crank chamber 5. As this occurs, the inclination angle of the swash plate 12 is increased, whereby the discharge capacity of the compressor C is increased. When the communication passage 28 is fully closed, the pressure in the crank chamber 5 decreases remarkably, and the inclination angle of the swash plate 12 becomes a maximum, whereby the discharge capacity (the amount of circulating refrigerant) of the compressor C also becomes a maximum.

On the contrary, in the case where the cooling load is small, the solenoid portion 31 decreases the biasing force so that the valve element 32 increases the opening degree of the communication passage 28. As a result, the valve element 32 moves to increase the opening degree of the communication passage 28, whereby the pressure in the crank chamber 5 is increased, and the inclination angle of the swash plate 12 is decreased, the discharge capacity (the amount of circulating refrigerant) of the compressor C being decreased. When the communication passage 28 is fully opened, the pressure in the crank chamber 5 is largely increased, and the inclination angle of the swash plate 12 becomes a minimum, the discharge capacity of the compressor C also becoming a minimum.

Refrigerant delivered from the cylinder bores 1*a* into the discharge chamber 22 is introduced into the separation chamber 42A via the introduction passage 42C and the introduction opening 42B. As this occurs, a mist of lubricating oil contained in the refrigerant is also introduced into the separation chamber 42A together with the refrigerant. The refrigerant and the lubricating oil turns along the gap between the inner circumferential surface of the case 42 and the outer circumferential surface of the valve casing 43 of the check valve 41. While turning, the lubricating oil is centrifugally separated, and after being collected at the inclined recessed portion 42D, the lubricating oil is introduced into the crank chamber 5 via the discharge passage 42E, the communication passage 28 and the control valve 30. The lubricating oil so introduced into the crank chamber 5 then lubricates mechanical components (bearings and hinge mechanism) in the crank chamber 5.

The refrigerant separated from the lubricating oil enters the valve chamber 43A via the valve inlet 43B. As this occurs, the refrigerant pushes up the valve element 45, enters the valve chamber 43A after passing through the gap formed between the bottom of the valve element 45 and the valves eat having the valve inlet 43B, passes through the grooves 45A and reaches the valve outlet 44A. When the valve element 45 is in abutment with the disc 44 by being pushed up by the refrigerant, the refrigerant passes through the grooves 45A and thereafter reaches the valve outlet 44A via a gap formed by the disc 44 and the notched portions 45B. When having reached the outside of the valve chamber 43A via the valve outlet 44A, the refrigerant then enters the external refrigerant circuit 50 via the flow pipe 22B for heat exchanging operation.

With the embodiment, the following effects can be obtained.

(1) Since the check valve 41 is provided between the discharge chamber 22 and the external refrigerant circuit 50, the reverse flow of refrigerant from the external refrigerant circuit 50 side to the discharge chamber 22 can be prevented. That is, when the compressor C is stopped, there is no risk that the communication passage 28 is fully opened when the activation of the solenoid portion 31 of the control valve 30 is stopped, and that the high pressure refrigerant on the external refrigerant circuit 50 side reaches the crank chamber 5 via the discharge chamber 22, the unit 40 and the communication passage 28 to thereby increase the crank pressure Pc drastically abnormally. Consequently, it is possible to prevent the aforesaid sliding displacement of the drive shaft 6 and problems that would be caused by the sliding displacement of the drive shaft 6. The problems (a), (b) and (c) discussed with respect to the prior art compressor before can be considered, problems that would otherwise be caused.

(2) Since an abnormal increase in the crank pressure Pc, when the activation of the control valve 30 is stopped, is prevented by providing the check valve 41, premature deterioration of the lip seal 2A can be suppressed, thereby making it possible to improve the durability of the compressor C.

(3) Since the increase in the amount of lubricating oil to be discharged to the external refrigerant circuit 50 side is suppressed by providing the oil separator between the discharge chamber 22 and the external refrigerant circuit 50, not only can the heat exchange efficiency of the external refrigerant circuit 50 be improved but also the lubricating efficiency within the compressor C can be improved.

(4) Since the lubricating oil separated at the unit 40 is introduced into the crank chamber 5, the crank chamber 5 can be lubricated with the lubricating oil so introduced therein. There are provided in the crank chamber 5 a relatively large number of sliding portions of mechanisms for converting the rotating motion of the drive shaft 6 into the reciprocating motion of the piston 20 (for example, the front thrust bearing 9A, the hinge mechanism 13, the swash plate 12 and shoe 19). Due to this, with the lubricating efficiency of the sliding portion of the crank chamber 5 being improved, the operation efficiency of the compressor C can be improved.

(5) The oil separator is disposed upstream of the check valve 41, whereby the oil supply passage for introducing the lubricating oil separated by the oil separator into the crank chamber 5 is disposed upstream of the check valve 41 together with the oil separator. That is, even if the downstream side of the check valve 41 becomes higher in pressure than the upstream side, there is no risk of refrigerant on the downstream side flowing in a reverse direction to the upstream side via the oil supply passage. Consequently, the reverse flow of refrigerant can be prevented without providing, along the oil supply passage, a closing means for closing the passage.

(6) Since the check valve 41 and the oil separator are integrated into the unit 40, the space where the two components are to be installed can be reduced as a whole when compared with the case where the check valve and the oil separator are provided separately. In addition, since the unit 40 is designed to be assembled to the rear housing 4, the assembly and maintenance works can be improved.

(7) The check valve 41 is disposed in the case 42, and the separation of lubricating oil is carried out on the outer circumference of the valve casing 43, while the reverse flow of refrigerant is prevented in the inner circumference of the valve casing 43. Namely, the valve casing 43 is constructed to be shared in the lubricating oil separating function and the refrigerant reverse flow preventing function. Consequently, the number of components used in the compressor can be reduced, thereby making it possible to reduce the production cost.

(8) The valve element 45 is disposed so as to reciprocate by being guided by the inner circumference side of the cylindrical casing 43 having the bottom, and the grooves 45A are formed in the outer circumference of the valve element 45, whereby the refrigerant flowing from the valve inlet 43B formed below the valve element 45 passes through the grooves 45A to reach the valve outlet 44A formed above the valve element 45. In the case where no grooves 45A are formed in the outer circumference of the valve element 45, since the refrigerant cannot pass through the valve element 45 vertically, a hole must be formed in the circumferential surface of the valve casing 43 for the refrigerant to pass through from the inside to the outside of the valve casing 43. Moreover, in this case, in order to prevent the refrigerant, flowing from the introduction opening 42B, from entering the valve casing 43 via the hole, an external casing for accommodating the valve casing 43 is to be further provided so that refrigerant and lubricating oil can turn around the outer circumference of such an external casing. In contrast to this, according to the present invention, the grooves 45A are formed on the valve element 45 so that the refrigerant can vertically pass through the valve element 45, whereby the number of components used can be reduced, thereby making it possible to reduce the production cost.

(9) Since the notched portions 45B as well as the grooves 45A are formed in the valve element 45, even if the valve element 45 is pushed up to abut with the disc 44, the refrigerant can pass through the notched portion 45B to reach the valve outlet 44A.

(10) Since the disc 44 is shared as a member for forming the separation chamber 42A, as well as for forming the valve chamber 43A, the production cost can be reduced by reducing the number of components.

(11) The inclined recessed portion 42D is provided in the case 42 so as to guide lubricating oil dropping along the wall surface of the separation chamber 42 (the inner circumferential surface of the case 42) to the discharge passage 42E. Due to this, lubricating oil can be collected into the discharge passage 42E with ease, and moreover, the compressor C can be installed while being tilted within a predetermined angular range.

(12) Since the arrangement is such that the refrigerant and the lubricating oil turn around the outer circumferential side of the valve casing 43 of the check valve 41, the length of the unit 40 can be reduced, compared with the case where the oil separator is disposed in series on the upstream side of the check valve, whereby the installation space can also be reduced.

(13) Since the unit 40 is provided in the compressor C which is a variable capacity compressor, when the amount of the circulating refrigerant (the discharge capacity) is reduced, the check valve 41 cuts off the passage of refrigerant between the discharge chamber 22 and the external refrigerant circuit 50, whereby the lubricating oil is prevented from flowing out into the external refrigerant circuit 50.

(14) Part of the gas supply passage for supplying refrigerant in the discharge chamber 22 into the crank chamber 5 is constructed to function as the oil passage for supplying the lubricating oil separated by the oil separator to the crank chamber 5, and the control valve 30 is provided at the intermediate position in the gas supply passage (the oil passage) for adjusting the opening degree of the passage. Furthermore, the control valve 30 is constructed so that the valve opening is increased when the compressor is operating under the small capacity condition in which the amount of the circulating refrigerant (discharge capacity) is decreased and the amount of leaking refrigerant from the compression chamber 1*b* to the crank chamber 5 via the gap between the cylinder bore 1*a* and the piston 20 is decreased, whereby even when the compressor is operating under the small capacity condition in which the amount of lubricating oil to be supplied to the crank chamber 5 tends to be reduced, the lubricating oil can efficiently be supplied to the crank chamber 5 via the oil supply passage whose opening is increased. In addition, the common arrangement of the communication of the gas supply passage and the oil passage can simplify the construction of the compressor C.

Second Embodiment

In a compressor C according to a second embodiment of the present invention, the construction of the unit 40 used in the first embodiment is modified, and the remaining features of the compressor of the second embodiment are identical to those of the compressor of the first embodiment. Consequently, in the drawings, like reference numerals are used for like components and a description thereof will be omitted here.

Figure 5:
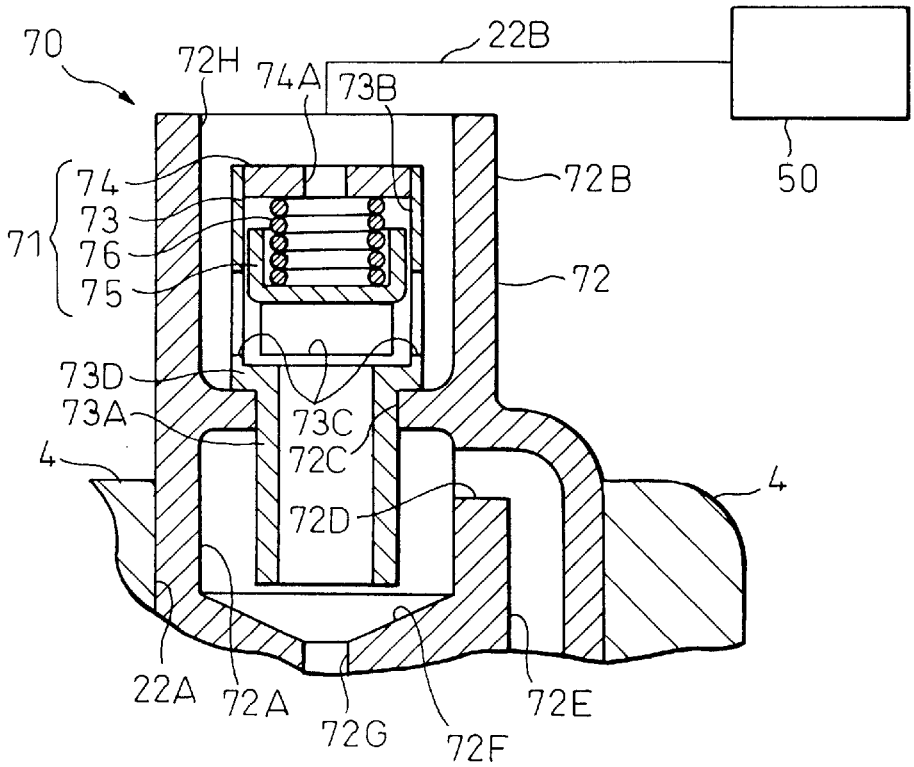
FIG. 5 is an enlarged cross-sectional view showing a main part of a compressor of a second embodiment, with the valve in the open position.
Figure 6:
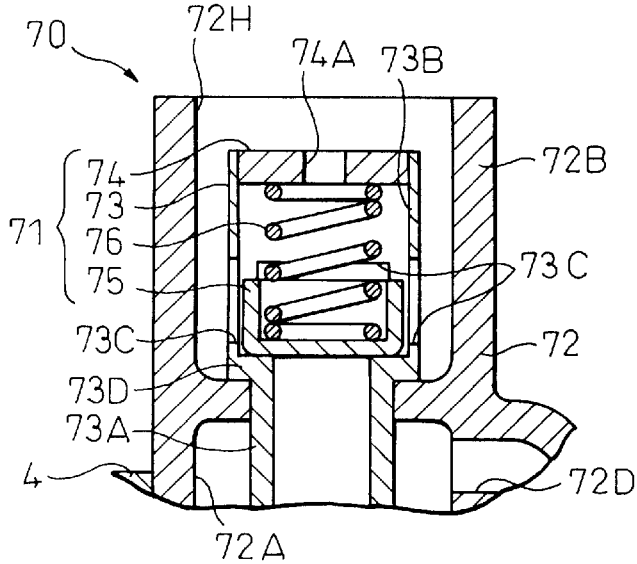
FIG. 6 is an enlarged cross-sectional view showing the main part of the compressor of the second embodiment, with the valve in the closed position.
Figure 7:
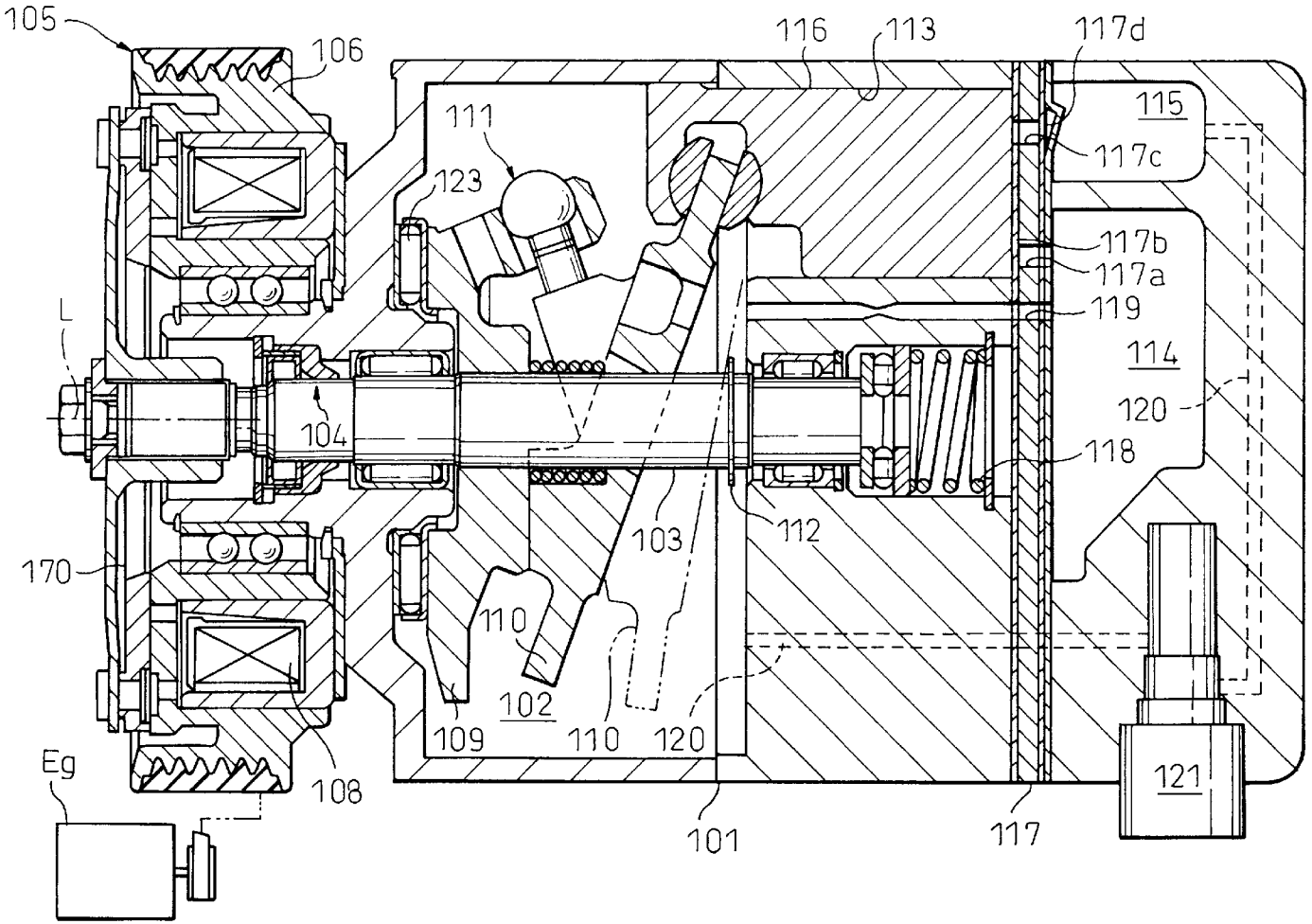
Fig.7 PRIOR ART
FIG. 7 is a cross-sectional view showing a main part of a compressor according to the prior art.

A unit 70 is mounted in a mounting opening 22A. As shown in FIGS. 5 and 6, the unit 70 comprises a check valve 71 and a substantially cylindrical unit case 72 having a bottom for accommodating the check valve 71. The check valve 71 comprises a substantially cylindrical casing 73 and a disc 74. The valve casing 73 has an inlet side cylindrical portion 73A extending from the axially intermediate position to the bottom thereof, the cylindrical portion 73A having a diameter smaller than that of an upper portion of the valve casing 73. A valve chamber 73B is formed in the upper large-diameter portion of the valve casing 73 with the upper end portion of the valve casing 73 covered with the disc 74. Formed in the valve casing 73 is a valve outlet 73C for providing a communication between the valve chamber 73B and the exterior of the valve casing 73. A step portion 73D is formed between the valve chamber 73B and the inlet side cylindrical portion 73A of the valve casing 73. A communicating hole 74A is formed in the disc 74, so that the inside and outside of the valve chamber 73B are allowed to communicate with each other. A valve element 75 is accommodated in the valve casing 73 chamber 73B so as to move reciprocally in the axial direction. The valve element 75 is biased toward the inlet side cylindrical portion 73A with a valve closing spring 76.

The valve element 75 has a cylindrical shape having a bottom. When pressed against the step portion 73D with the valve closing spring 76, the valve element 75 is constructed to close a passage between the valve chamber 73B and the inlet side cylindrical portion 73A (see FIG. 6).

Similarly to the check valve 41 in the first embodiment, in the check valve 71, a reverse flow of the refrigerant from the downstream side (the external refrigerant circuit 50 side) to the upstream side (the discharge chamber 22 side) is regulated by the balance among the biasing force of the valve element 75 by virtue of the refrigerant pressure on the upstream side of the check valve 71, the biasing force against the valve element 75 by virtue of the refrigerant pressure on the downstream side of the check valve 71 and the biasing force of the valve closing spring 76.

A separation chamber 72A is formed in the interior of the unit case 72, and a cylindrical protruding wall 72B is provided so as to extend above the separation chamber 72A. An insertion hole 72C is formed on the upper side of the separation chamber 72A, and the check valve 71 is mounted in the insertion hole 72C. An opening in the upper end of the protruding wall 72B functions as a discharge opening 72H for discharging the refrigerant therefrom. Note that in FIGS. 5 and 6, as a matter of convenience, a mechanism for fixedly connecting the discharge opening 72H to the flow pipe 22B is not shown.

The inlet side cylindrical portion 73A of the check valve 71 is press fitted in the insertion hole 72C and is disposed such that the lower end opening in the inlet side cylindrical portion 73A reaches in the vicinity of the bottom portion of the separation chamber 72A. An introduction opening 72D is formed in the unit case 72 for introducing the refrigerant in the discharge chamber 22 into the separation chamber 72A. The introduction opening 72D and the discharge chamber 22 are connected to each other via an introduction passage 72E. The introduction opening 72D is formed along the circumferential direction of the unit case 72 such that the refrigerant introduced into the separation chamber 72A turns within the separation chamber 72A. Since the inlet side cylindrical portion 73A is disposed in the separation chamber 72A, in practice, the refrigerant introduced from the introduction opening 72D into the separation chamber 72A turns along a gap between the inner circumferential surface of the separation chamber 72A and the outer circumferential surface of the inlet side cylindrical portion 73A. Lubricating oil contained in the refrigerant is centrifugally separated from the refrigerant to gather at the circumferential surface of the separation chamber 72A.

In addition, an inclined recessed portion 72F is formed in the bottom portion of the separation chamber 72A, and the gathered lubricating oil drops along the circumferential surface of the separation chamber 72A and is collected in the deepest portion in the inclined recessed portion 72F with ease. A discharge passage 72G is formed in the deepest portion of the inclined recessed portion 72F for, discharging the lubricating oil so collected out of the unit 70, and thus the lubricating oil is introduced into the crank chamber 5, as a low pressure region, via the discharge passage 72G, a communication passage 28 and a control unit 30. An oil separator for separating a mist of lubricating oil from the refrigerant containing the mist of lubrication oil is constituted by the lower side of the unit case 72 and the inlet side cylindrical portion 73A. In this case, the discharge passage 72G, the communication passage 28 and control valve 30 function as an oil passage for supplying the lubricating oil separated by the oil separator to the crank chamber 5. Additionally, the introduction passage 72E, the introduction opening 72D, the separation chamber 72A and the discharge passage 72*g* function as part of the gas supply passage for supplying the refrigerant in the discharge chamber 22 into the crank chamber 5.

In addition, a discharge passage for connecting the discharge chamber 22 to the external refrigerant circuit 50 is constituted by the mounting opening 22A, the unit 70 and the flow passage 22B.

Refrigerant discharged from the cylinder bore 1*a* into the discharge chamber 22 is introduced into the separation chamber 72A via the introduction passage 72E and the introduction opening 72D. A gas mixture of refrigerant and lubricating oil turns along the gap between the circumferential surface of the separation chamber 72A and the outer circumferential surface of the inlet side cylindrical portion 73A of the check valve 71. Lubricating oil is centrifugally separated by this turning and is guided into the discharge passage 72G by the inclined recessed portion 72F for introduction into the crank chamber 5 via the communicating passage 28 and the control valve 30.

The refrigerant separated from the lubricating oil enters the valve chamber 73B via the inner circumference of the inlet side cylindrical portion 73A. As this occurs, the refrigerant pushes up the valve element 75, enters the valve chamber 73B by passing through the gap formed between the bottom portion of the valve element 75 and the step portion 73D, reaches the outside of the valve chamber 73B through the valve outlet 73C, and thereafter enters the external refrigerant circuit 50 via the flow pipe 22B for heat exchange.

When the biasing force against the valve element 75, by virtue of the refrigerant pressure transmitted from the upstream side of the check valve 71 via the inner circumference of the inlet side cylindrical portion 73A, becomes smaller than the sum of the biasing force against the valve element by the refrigerant pressure transmitted from the downstream side via the communication hole 74A and the biasing force of the valve closing spring 46, the valve element 75 shuts off the communication between the valve chamber 73B and the inlet side cylindrical portion 73A. That is, the check valve 71 prevents a reverse flow of the refrigerant from the downstream side (the external refrigerant circuit 50 side) to the upstream side (the discharge chamber 22 side).

In this embodiment, in addition to the effects corresponding to the aforesaid effects (1) to (6), (11), (13) and (14), the following effect will be obtained.

(15) The turning operation needed to separate the lubricating oil from the refrigerant is effected by making use of the inlet side cylindrical portion 73A integrally formed with the valve casing 73. In other words, part of the check valve 71 is used in the turning operation. Consequently, the production cost can be reduced by reducing the number of components used.

The present invention is not limited to the embodiments described heretofore but the following modifications may be adopted.

The unit 40 (or 70) does not have to be provided in such a manner as to protrude outwards of the rear housing 4 but maybe provided in such a manner as to be accommodated within the rear housing 4.

The unit 40 (or 70) may be provided in the discharge chamber 22. Namely, the unit 40 (or 70) may be assembled to the rear housing 4 before the rear housing 4 is joined to the valve forming unit 3 so that the unit 40 (or 70) cannot be disassembled once the housing is completed. On the contrary, the housing of the compressor C is completed by assembling together the cylinder block 1, the front housing 2 and the valve forming unit 3, and thereafter the rear housing 4 may be retrofitted from the outside of the housing so completed. When the rear housing is retrofitted, good maintenance properties can be provided.

Lubricating oil separated from the refrigerant may be supplied to the suction chamber 21, the suction opening 21A or the flow pipe 21B which functions as the low pressure area. Lubricating oil supplied to the suction chamber 21, the suction opening 21A or the flow pipe 21B is sucked into the cylinder bore 1*a* together with refrigerant by virtue of the reciprocating motion of the piston 20 to thereby lubricate the interior of the cylinder bore 1*a*. Thereafter, part of the lubricating oil leaks to the crank chamber 5 via the gap between the cylinder bore 1*a* and the piston 20 to thereby lubricate sliding components of mechanisms inside the crank chamber 5.

Lubricating oil separated from the refrigerant may directly be supplied to the crank chamber 5 without passing through the control valve 30. In this case, the amount of the lubricating oil for use in lubricating the sliding components of the mechanisms in the crank chamber 5 is increased to thereby improve the lubricating efficiency, compared with the case where the lubricating oil is so supplied via the control valve 30.

The oil passage and the gas supply passage may be provided separately.

The inclined recessed portion 42D (or 72F) does not always have to be provided.

While the case 42 (or the unit case 72) can be separated from the rear housing 4, it may be integrated with the latter. Namely, the case 42 (or unit case 72) may be formed integrally with the rear housing 4. Even in this case, if the check valve 41 (or 71) is constructed so as to be assembled in the interior of the case 42 (or unit case 72) from the outside of the rear housing 4, assembly and maintenance work can be carried out without any problem.

The check valve 71 and the oil separator may be provided separately in the unit case 72 without using a component common to the two components. For example, the inlet side cylindrical portion 73A is separated from the valve casing 73, and the inlet side cylindrical portion 73A so separated is then fixed in the insertion hole 72C separately from the check valve 71.

The check valve 41 (or 71) and the oil separator do not have to be integrated into the unit 40 (or 70).

Instead of the construction in which the cam plate (swash plate 12) rotates together with the drive shaft 6, a construction may be used for the compressor C in which a cam plate is supported on a drive shaft relatively rotateably so that the plate can wobble, or a wobble type compressor can be adopted.

A hinge mechanism 13 may be used, which comprises a first arm provided on the swash plate 12, a second arm provided on the lug plate 11, a guide hole formed in one of the first and second arms, a mounting hole formed in the other arm, and a pin which penetrates through the mounting hole and has a projection which is inserted into the guide hole.

The control computer 30 does not have to be the aforesaid control computer or of an external control type in which the computer is controlled by an external device such as the drive circuit, but may be of an internal control type in which a completely autonomous control is carried out.

The compressor C may be of a fixed capacity type in which the stroke of the piston 20 cannot be changed.

The oil separator may be disposed downstream of the check valve 41. In this case, it is desirable to provide a closing means along the oil passage.

Next, technical concepts other than the various aspects of the present invention claimed herein which can be grasped from the embodiments will be described below together with their effectiveness.

According to the first aspect of the invention, the check valve and the oil separator are provided as separate units. In this case, the degree of freedom in the arrangement of the individual components can be improved because the components are provided as separate units.

As described heretofore, according to the present invention, in the compressor, the reverse flow of the refrigerant from the external refrigerant circuit to the discharge chamber can be prevented, and also the discharge of the lubricating oil to the external refrigerant circuit can be suppressed.

What is claimed is:

1. A compressor comprising:

a housing having a compression chamber, a discharge chamber, and a suction chamber, a refrigerant being sucked from said suction chamber into said compression chamber and discharged from compression chamber into said discharge chamber;

a movable member to compress the refrigerant in the compression chamber;

a discharge passage connecting the discharge chamber to an external refrigerant circuit; and a suction passage connecting the suction chamber to the external refrigerant circuit;

wherein a check valve preventing reverse flow of the refrigerant from said external refrigerant circuit to said discharge chamber, an oil separator separating a mist of lubricating oil contained in the refrigerant from the refrigerant, and an oil passage introducing the separated lubricating oil into a low pressure region in the compressor, are provided in said discharge chamber or said discharge passage.

2. A compressor according to claim 1, wherein said oil separator is disposed upstream of said check valve.

3. A compressor according to claim 1, wherein said check valve and said oil separator are integrally arranged as a unit.

4. A compressor according to claim 3, wherein said unit comprises a case to which said check valve is attached, said case having a substantially cylindrical portion having an inlet opening for introducing the refrigerant into said case such that the refrigerant turns about an axis of said case, said case also having an outlet for the refrigerant which passes through said check valve after said refrigerant is separated from said lubricating oil, and an outlet for the lubricating oil which is separated from the refrigerant.

5. A compressor according to claim 4, wherein the refrigerant turns in the circumferential gap between an inner circumferential surface of the case and an outer circumferential surface of the check valve.

6. A compressor according to claim 4, wherein said check valve comprises a valve casing having a valve seat, a valve element arranged in said valve casing, and an urging member resiliently urging said valve element toward said valve seat, said valve casing being attached to said case.

7. A compressor according to claim 6, wherein said valve element has an outer circumferential surface and at least one groove axially extending in said outer circumferential surface.

8. A compressor according to claim 4, wherein said housing has a structure to which said case of said unit is mounted.

9. A compressor according to claim 1, wherein said compressor is a variable capacity compressor comprising a crank chamber formed in said housing, a drive shaft rotatably supported in said crank chamber, a swash plate driven for rotation by said drive shaft and supported by said drive shaft so that an inclination angle thereof relative to said drive shaft changes, a piston as the movable member operatively coupled to said swash plate, a cylinder bore for reciprocally accommodating therein said piston and in which said compression chamber is formed by said piston, a gas bleed passage for providing a communication between said suction chamber, and said crank chamber and a control valve for controlling a pressure in said crank chamber so as to vary the stroke of said piston.

10. A compressor according to claim 9, wherein said low pressure region is said crank chamber, and wherein the lubricating oil separated by said oil separator is supplied to said crank chamber via said oil passage.

11. A compressor according to claim 10, wherein said control valve regulates the opening degree of said oil passage so as to supply lubricating oil separated by said oil separator to said crank chamber and varies the pressure in said crank chamber so as to vary the stroke of said piston.

* * * * *